United States Patent [19]

Watson et al.

[11] Patent Number: 4,459,760

[45] Date of Patent: Jul. 17, 1984

[54] APPARATUS AND METHOD TO COMMUNICATE INFORMATION IN A BOREHOLE

[75] Inventors: Fred L. Watson, Templeton; Donald H. Van Steenwyk, San Marino, both of Calif.

[73] Assignee: Applied Technologies Associates, San Marino, Calif.

[21] Appl. No.: 351,743

[22] Filed: Feb. 24, 1982

[51] Int. Cl.[3] ..... E21B 47/022

[52] U.S. Cl. ..... 33/312; 340/858

[58] Field of Search ..... 33/304, 312, 313; 340/856–858

[56] References Cited

U.S. PATENT DOCUMENTS

| | | | |
|---|---|---|---|
| 2,309,905 | 2/1943 | Irwin et al. . | |
| 2,635,349 | 4/1953 | Green . | |
| 2,674,049 | 4/1954 | James, Jr. . | |
| 2,681,657 | 6/1954 | Widess . | |
| 2,806,295 | 9/1957 | Ball . | |
| 3,037,295 | 6/1962 | Roberson . | |
| 3,052,029 | 9/1962 | Wallshein . | |
| 3,137,077 | 6/1964 | Rosenthal . | |
| 3,241,363 | 3/1966 | Alderson et al. . | |
| 3,308,670 | 3/1967 | Granqvist . | |
| 3,561,129 | 2/1971 | Johnston . | |
| 3,753,296 | 8/1973 | Van Steenwyk . | |
| 3,862,499 | 1/1975 | Isham et al. | 33/312 |
| 3,894,341 | 7/1975 | Kapeller . | |
| 3,959,767 | 5/1976 | Smither et al. | 340/858 |
| 4,199,869 | 4/1980 | Van Steenwyk . | |
| 4,216,536 | 8/1980 | More | 340/856 X |
| 4,244,116 | 1/1981 | Barriac . | |
| 4,293,815 | 10/1981 | West et al. | 33/312 X |

*Primary Examiner*—William D. Martin, Jr.

*Attorney, Agent, or Firm*—William W. Haefliger

[57] ABSTRACT

The invention concerns efficient transmission of borehole survey signals or data from depth level in a borehole or well to the well surface, for analysis, display or recordation; further it concerns supply of DC power downwardly to the instrumentation via the same wireline via which such survey data or signals are transmitted upwardly.

9 Claims, 12 Drawing Figures

U13
U4
U5
U6
U9
A/D CONVERTER
U8
U12
U14
R4
R5
R9
R10
R12
R14
R15
R8
R7
CR1
CR2
CR3
C5
C7
+12V
-12V
+10V
CONV COMP
START
ANALOG IN
+VREF
COMP OUT
COMP +
CLK
BT 12
BT 11
BT 10
BT 9
BT 8
BT 7
BT 6
BT 5
BT 4
BT 3
BT 2
BT 1

APPARATUS AND METHOD TO COMMUNICATE INFORMATION IN A BOREHOLE

BACKGROUND OF THE INVENTION

This invention relates generally to mapping or survey apparatus and methods, and more particularly concerns efficient transmission of survey signals or data from depth level in a borehole or well to the well surface, for analysis, display or recordation; further it concerns supply of DC power downwardly to the instrumentation via the same wireline via which such survey data or signals are transmitted upwardly.

U.S. Pat. Nos. 3,753,296 and 4,199,869 disclose the use of angular rate sensors and acceleration sensors in boreholes to derive data usable in determination of borehole azimuth $\psi$ and tilt $\phi$; however, those patents do not specifically disclose how such data can be communicated to the surface of a well, in usable form, and with the unusual advantages of the simple, effective and reliable communication system as disclosed herein.

SUMMARY OF THE INVENTION

It is a major object of the invention to provide a data communication method and system of simple, effective, reliable, and improved form, for use in a borehole environment, as will appear. Basically, the system includes:

(a) means for suspending survey instrumentation in the borehole, (b) such instrumentation operating to generate analog signals in the borehole, (c) means responsive to reception of said signals for multiplexing the signals and converting same to digital signals, in the borehole, (d) means responsive to reception of said digital signals for converting the digital signals to digital words, (e) a two conductor wireline in the borehole connected to transmit versions of said digital words upwardly in the borehole, (f) and means for stripping the signal versions off the wireline at an upper elevation and processing the signal versions to a form usable in determination of borehole azimuth and/or tilt at the level of the instrumentation in the borehole.

As will be seen, the wireline also transmits power (such as DC power) from a source at the well head to the instrumentation suspended in the borehole; and the instrumentation may include one or more of the following:

(i) angular rate sensor means and acceleration sensor means operated to produce the analog signals and useful in determination of borehole azimuth or tilt;

(ii) temperature sensor means operated to produce the analog signals;

(iii) tubing or pipe collar locater means operated to generate the analog signals as such means is raised or lowered in the borehole; and (iv) magnetometer means operated to generate analog signals indicative of magnetic field conditions in the borehole.

The method of the invention typically includes the steps:

(a) suspending said instrumentation in the borehole, (b) operating said instrumentation to generate analog signals in the borehole, (c) multiplexing said signals and converting same to digital signals, in the borehole, (d) converting said digital signals to digital words, (e) operating a two conductor wireline in the borehole to transmit versions of said digital words upwardly in the borehole, (f) and stripping the signal versions off the wireline at an upper elevation and processing the signal versions to form usable in determination of borehole azimuth and/or tilt at the level of said instrumentation in the borehole.

These and other objects and advantages of the invention, as well as the details of an illustrative embodiment, will be more fully understood from the following specification and drawings, in which:

DRAWING DESCRIPTION

FIG. 1 is a circuit block diagram;

FIGS. 2*a* to 2*d* show details of certain blocks in FIG. 1;

FIGS. 3*a* and 3*b* show details of other blocks in FIG. 1;

DETAILED DESCRIPTION

Figure 4:
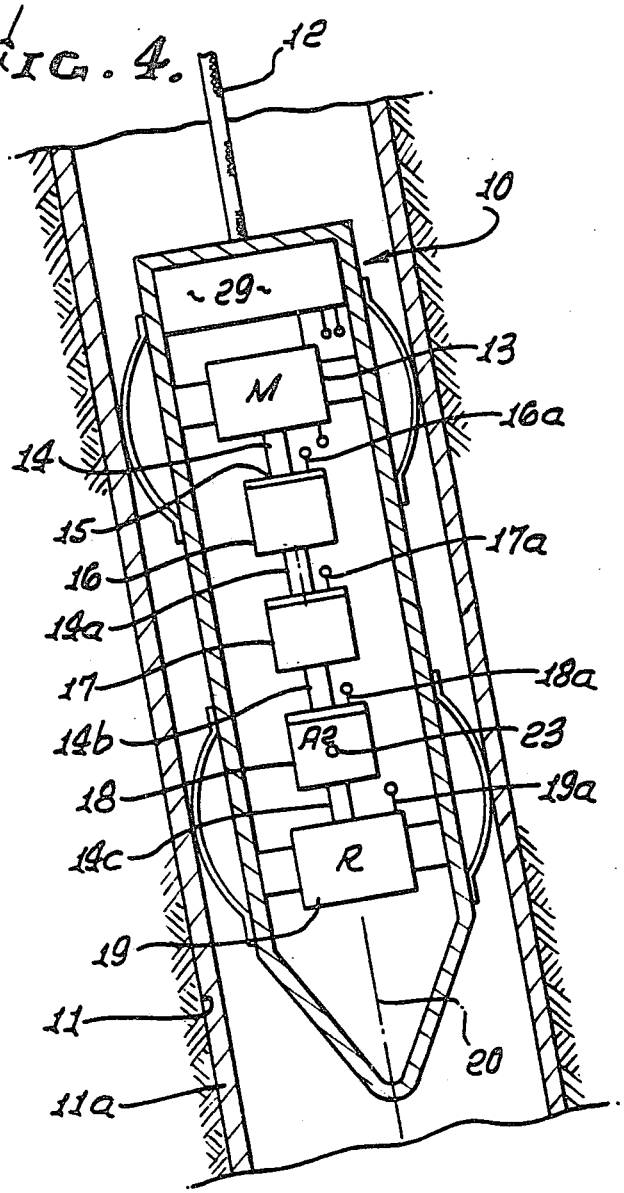
FIG. 4 is an elevation taken in section to show one form of instrumentation employing the invention.
Figure 4:
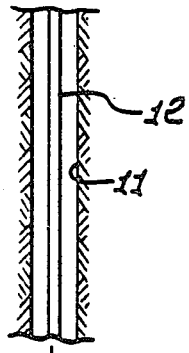
Figure 5:
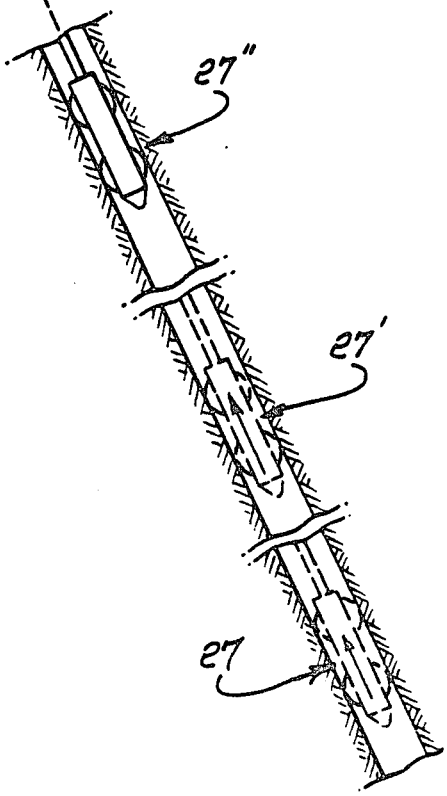
FIG. 5 is an elevation showing use of the FIG. 4 instrumentation in multiple modes, in a borehole.

Referring first to FIG. 4, a carrier such as elongated housing 10 is movable in a borehole indicated at 11, the hole being cased at 11*a*. Means such as a cable to travel the carrier lengthwise in the hole is indicated at 12. A motor or other manipulatory drive means 13 is carried by and within the carrier, and its rotary output shaft 14 is shown as connected at 15 to an angular rate sensor means 16. The shaft may be extended at 14*a*, 14*b* and 14*c* for connection to first acceleration sensor means 17, second acceleration sensor means 18, and a resolver 19. The accelerometers 17 and 18 can together be considered as means for sensing tilt. These devices have terminals 16*a*–19*a* connected via suitable slip rings with circuitry indicated at 29 carried within the carrier (or at the well surface, if desired).

The apparatus operates for example as described in U.S. Pat. No. 3,753,296 and as described above to determine the azimuthal direction of tilt of the borehole at a first location in the borehole. See for example first location indicated at 27 in FIG. 2. Other U.S. Patents describing such operation are Nos. 4,199,869, 4,192,077 and 4,197,654. During such operation, the motor 13 rotates the sensor 16 and the accelerometers either continuously, or incrementally.

The angular rate sensor 16 may for example take the form of one or more of the following known devices, but is not limited to them:

1. Since degree of freedom rate gyroscope
2. Tuned rotor rate gyroscope
3. Two axis rate gyroscope
4. Nuclear spin rate gyroscope
5. Sonic rate gyroscope
6. Vibrating rate gyroscope
7. Jet stream rate gyroscope
8. Rotating angular accelerometer
9. Integrating angular accelerometer 10. Differential position gyroscopes and platforms
11. Laser gyroscope
12. Combination rate gyroscope and linear accelerometer Each such device may be characterized as having a "sensitive" axis, which is the axis about which rotation occurs to produce an output which is a measure of rate-of-turn, or angular rate $\omega$. That value may have components $\omega_1$, $\omega_2$ and $\omega_3$ in a three axis co-ordinate system. The sensitive axis may be generally normal to the axis 20 of instrument travel in the borehole.

The acceleration sensor means 17 may for example take the form of one or more of the following known devices; however, the term "acceleration sensor means" is not limited to such devices:

1. one or more single axis accelerometers
2. one or more dual axis accelerometers
3. one or more triple axis accelerometers Examples of acceleration sensors include the accelerometers disclosed in U.S. Pat. Nos. 3,753,296 and 4,199,869, having the functions disclosed therein. Such sensors may be supported to be orthogonal to the carrier axis. They may be stationary on carouseled, or may be otherwise manipulated, to enhance accuracy and/or gain an added axis or axes of sensitivity. The axis of sensitivity is the axis along which acceleration measurement occurs.

Figure 6:
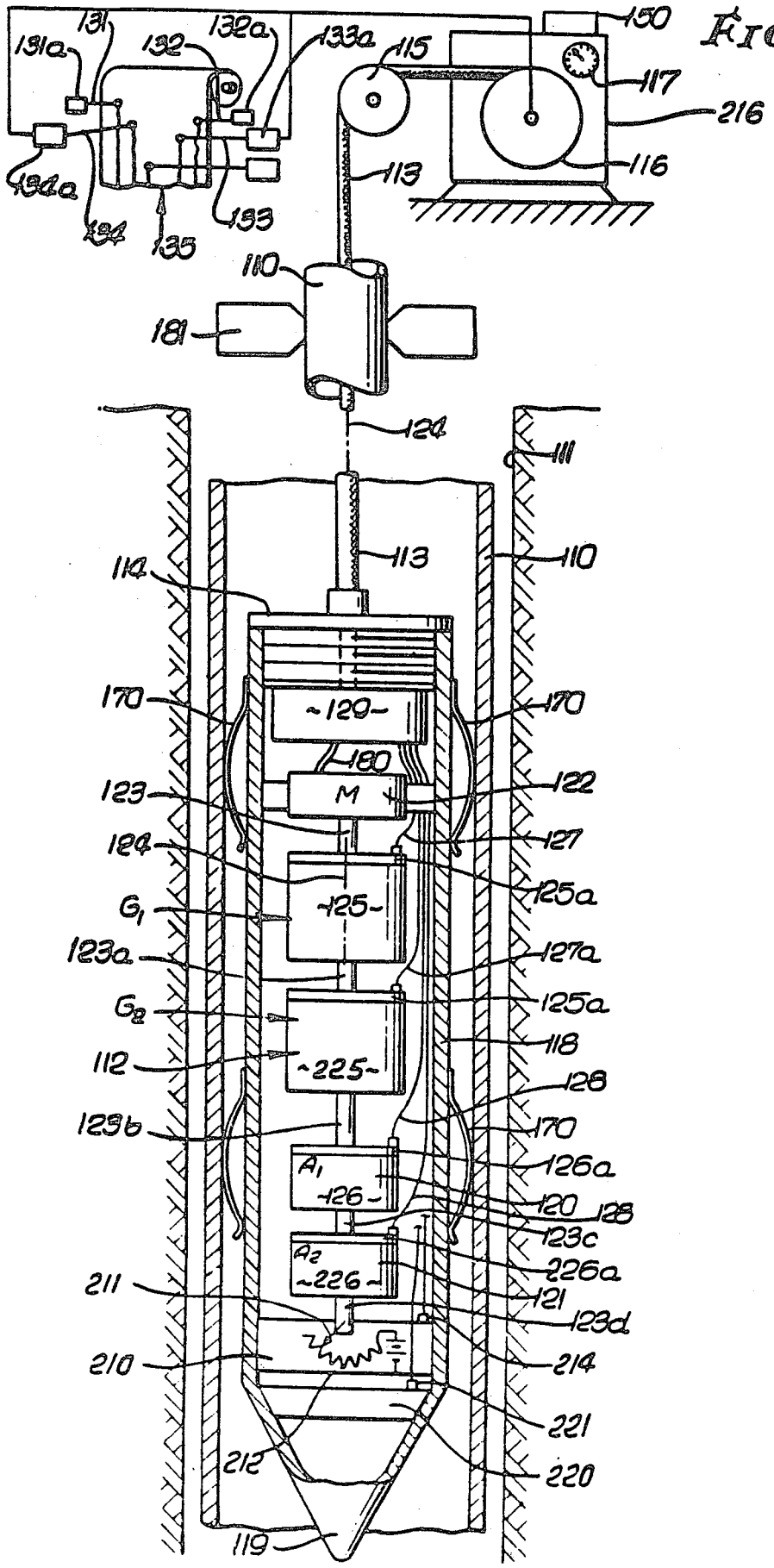
FIG. 6 is a vertical section showing further details of the FIG. 4 apparatus as used in a borehole.

FIG. 6 shows in detail dual input axis rate sensor means and dual output axis accelerometer means, and associated surface apparatus. In FIG. 6, well tubing 110 extends downwardly in a well 111, which may or may not be cased. Extending within the tubing is a well mapping instrument or apparatus 112 for determining the direction of tilt, from vertical, of the well or borehole. Such apparatus may readily be traveled up and down in the well, as by lifting and lowering of a cable 113 attached to the top 114 of the instrument. The upper end of the cable is turned at 115 and spooled at 116, where a suitable meter 117 may record the length of cable extending downwardly in the well, for logging purposes.

The apparatus 112 is shown to include a generally vertically elongated tubular housing or carrier 118 of diameter less than that of the tubing bore, so that well fluid in the tubing may readily pass, relatively, the instrument as it is lowered in the tubing. Also, the lower terminal of the housing may be tapered at 119, for assisting downward travel or penetration of the instrument through well liquid in the tubing. The carrier 118 supports first and second angular sensors such as rate gyroscopes $G_1$ and $G_2$, and accelerometers 120 and 121, and drive means 122 to rotate the latter, for travel lengthwise in the well. Bowed springs 170 on the carrier center it in the tubing 110.

The drive means 122 may include an electric motor and speed reducer functioning to rotate a shaft 123 relatively slowly about a common axis 124 which is generally parallel to the length axis of the tubular carrier, i.e. axis 124 is vertical when the instrument is vertical, and axis 124 is tilted at the same angle form vertical as is the instrument when the latter bears sidewardly against the bore of the tubing 110 when such tubing assumes the same tilt angle due to borehole tilt from vertical. Merely as illustrative, for the continuous rotation case, the rate of rotation of shaft 124 may be within the range 0.5 RPM to 5 RPM. The motor and housing may be considered as within the scope of means to support and rotate the gyroscope and accelerometers.

Due to rotation of the shaft 123, and lower extensions **123*a*, 123*b* and 123*c* thereof, the frames 125 and 225 of the gyroscopes and the frames 126 and 226 of the accelerometers are typically all rotated simultaneously about axis 124, within and relative to the sealed housing 118. The signal outputs of the gyroscopes and accelerometers are transmitted via terminals at suitable slip ring structures 125*a*, 225*a*, 126*a* and 226*a*, and via cables 127, 127*a*, 128 and 128*a*, to the processing circuitry at 129 within the instrument, such circuitry for example includes that to be described, including multiplexing means. The multiplexed output from such circuitry is transmitted via a lead in cable 113 to a surface recorder, as for example include pens 131–134 of a strip chart recorder 135, whose advancement may be synchronized with the lowering of the instrument in the well. The driver 131*a*–134*a* for recorder pens 131–134** are calibrated to indicate borehole azimuth, degree of tilt and depth, respectively, and another strip chart indicating borehole depth along its length may be employed, if desired. The recorder can be located at the instrument for subsequent retrieval and read-out after the instrument is pulled from the hole.

The angular rate sensor 16 may take the form of gyroscope $G_1$ or $G_2$, or their combination, as described in U.S. Pat. No. 4,199,869. Accelerometers 126 and 226 correspond to 17 and 18 in FIG. 4.

Figure 1:
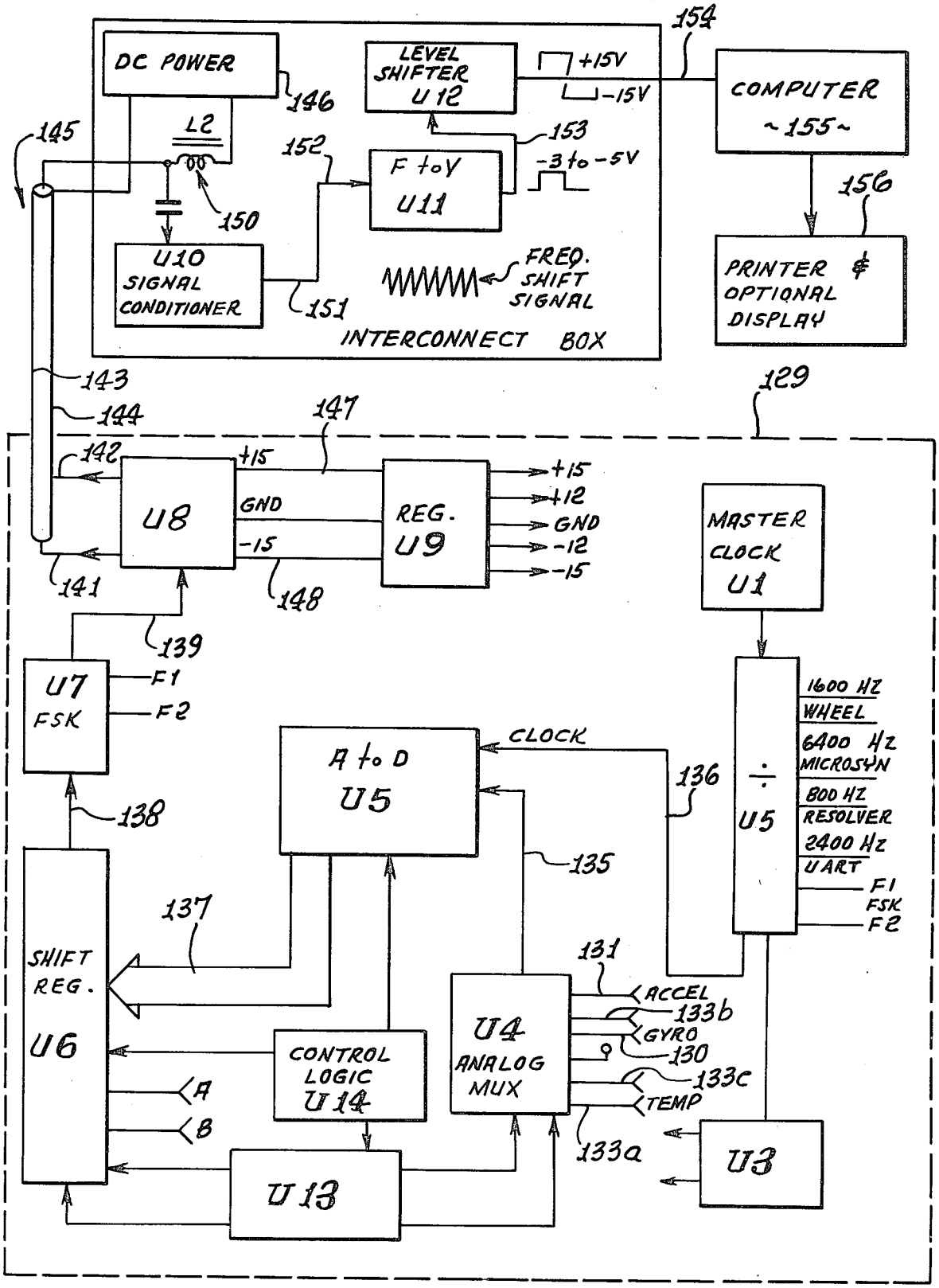
Figure 2A:
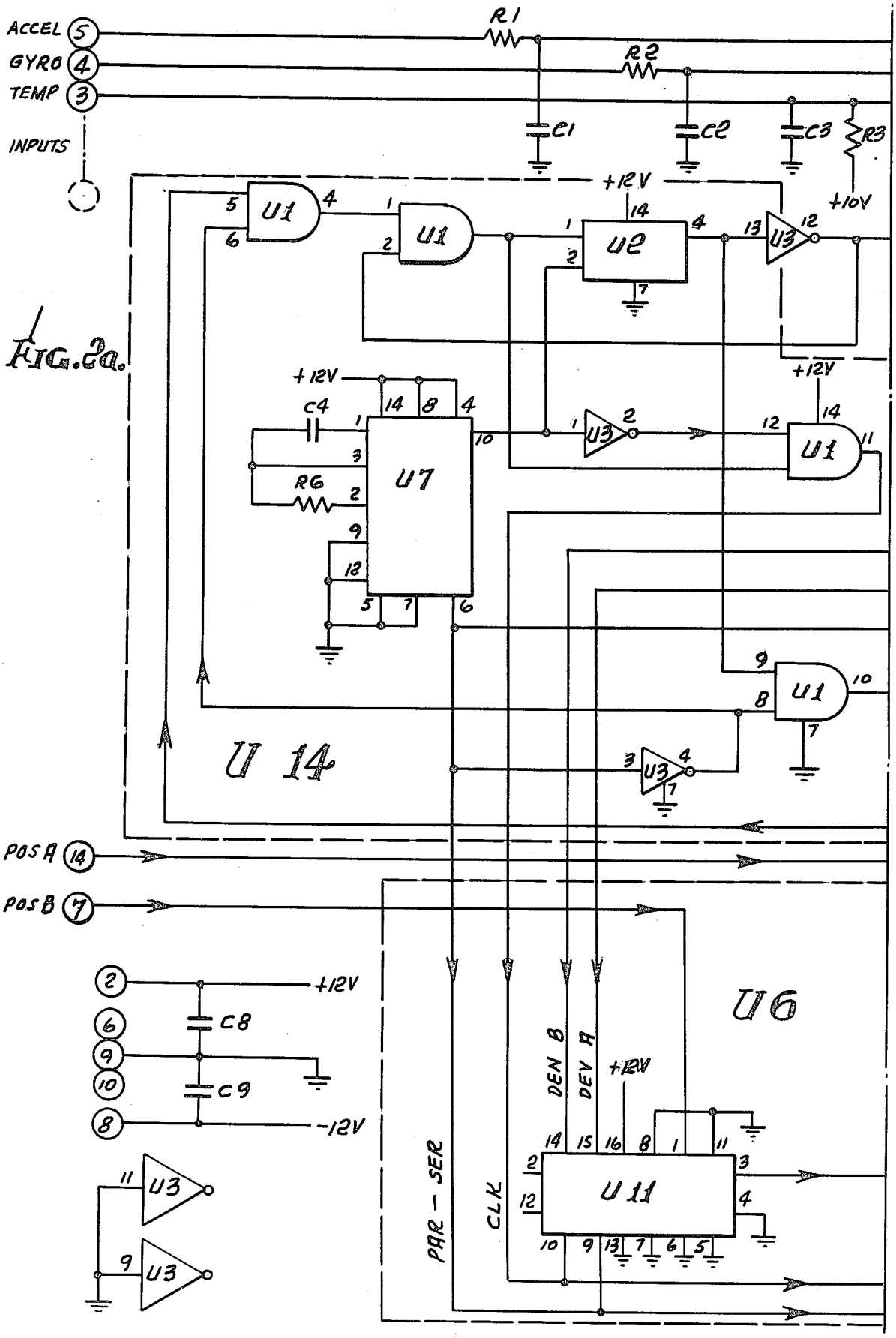
Figure 2B:
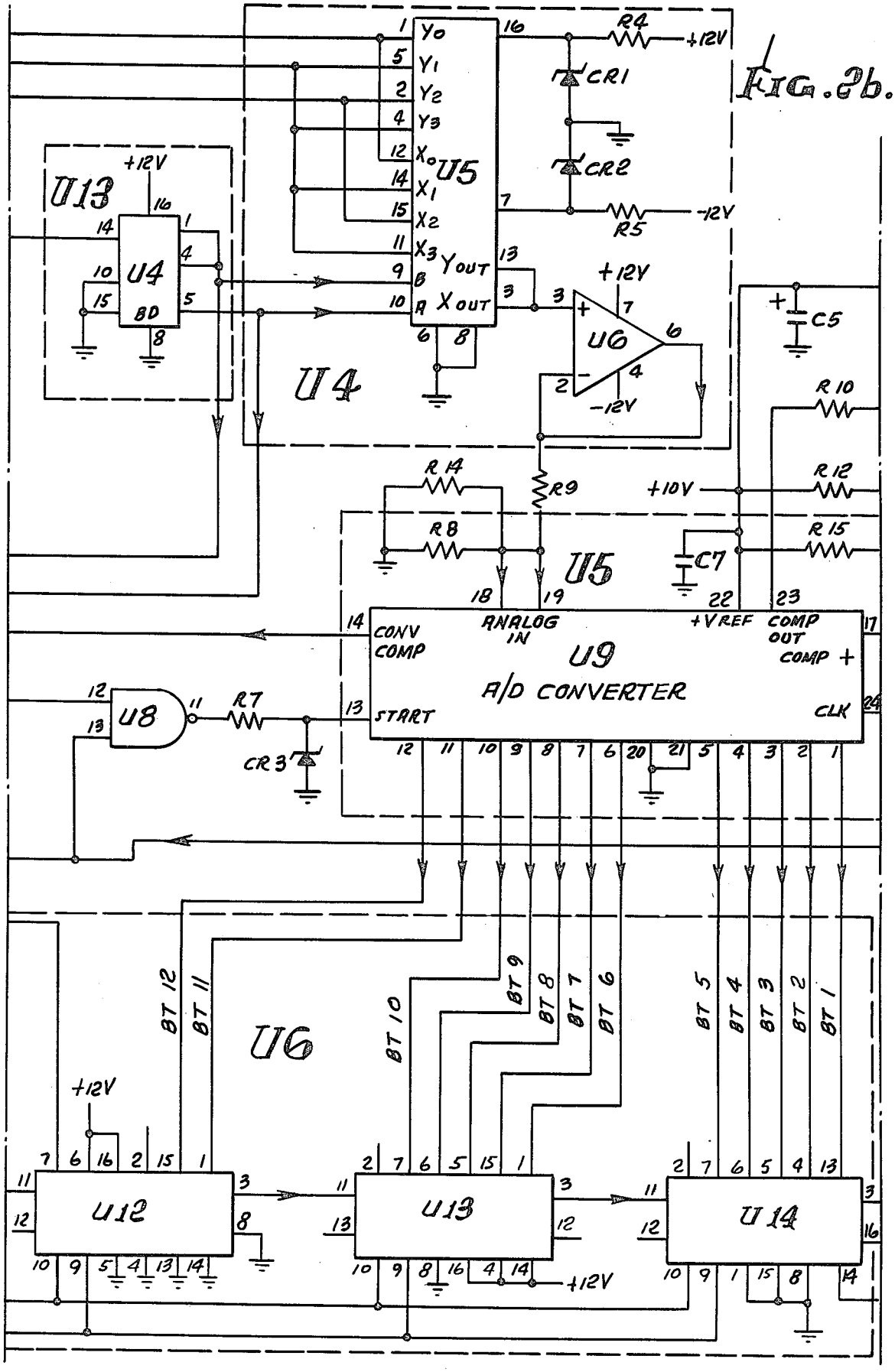
Figure 2C:
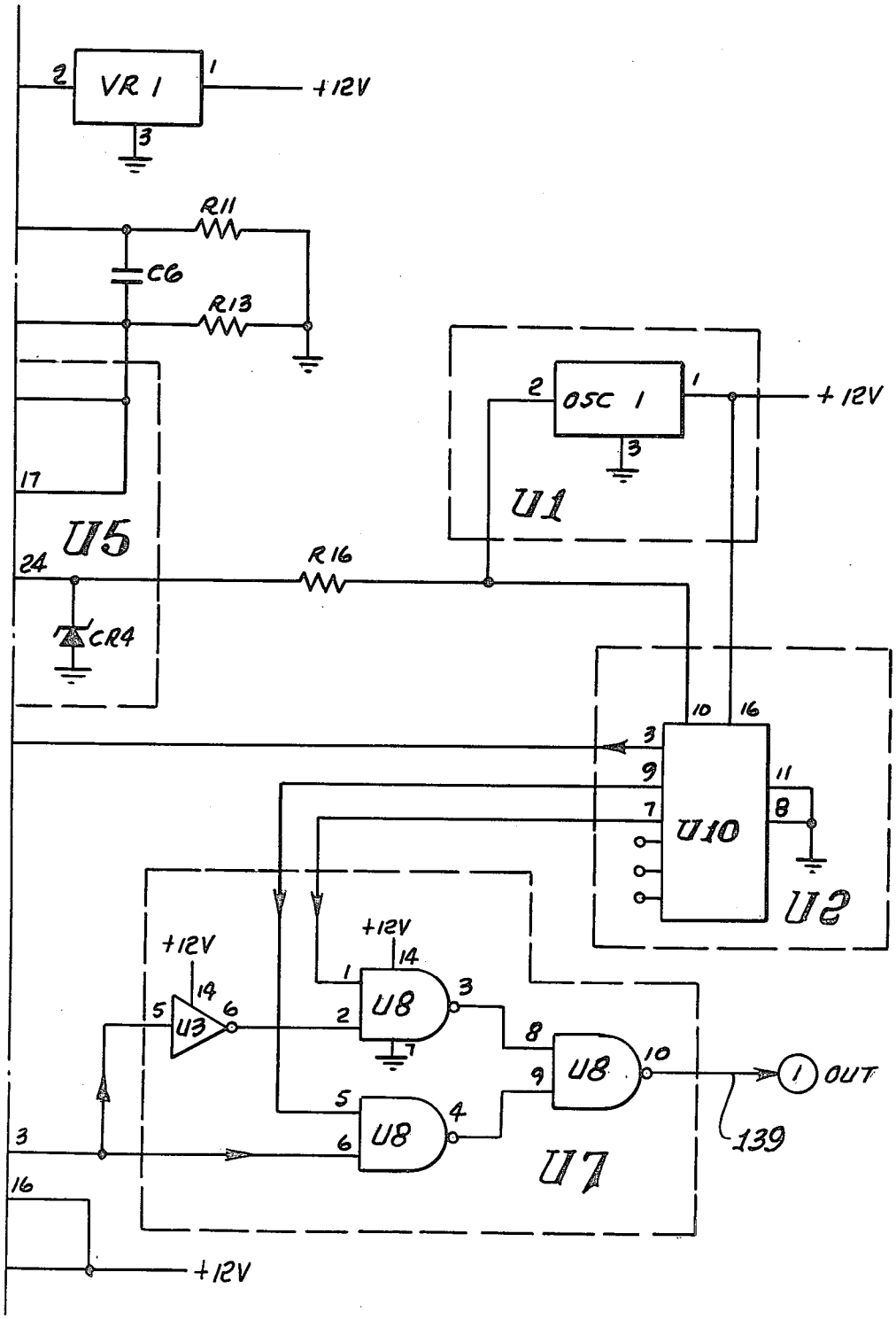
Figure 2D:
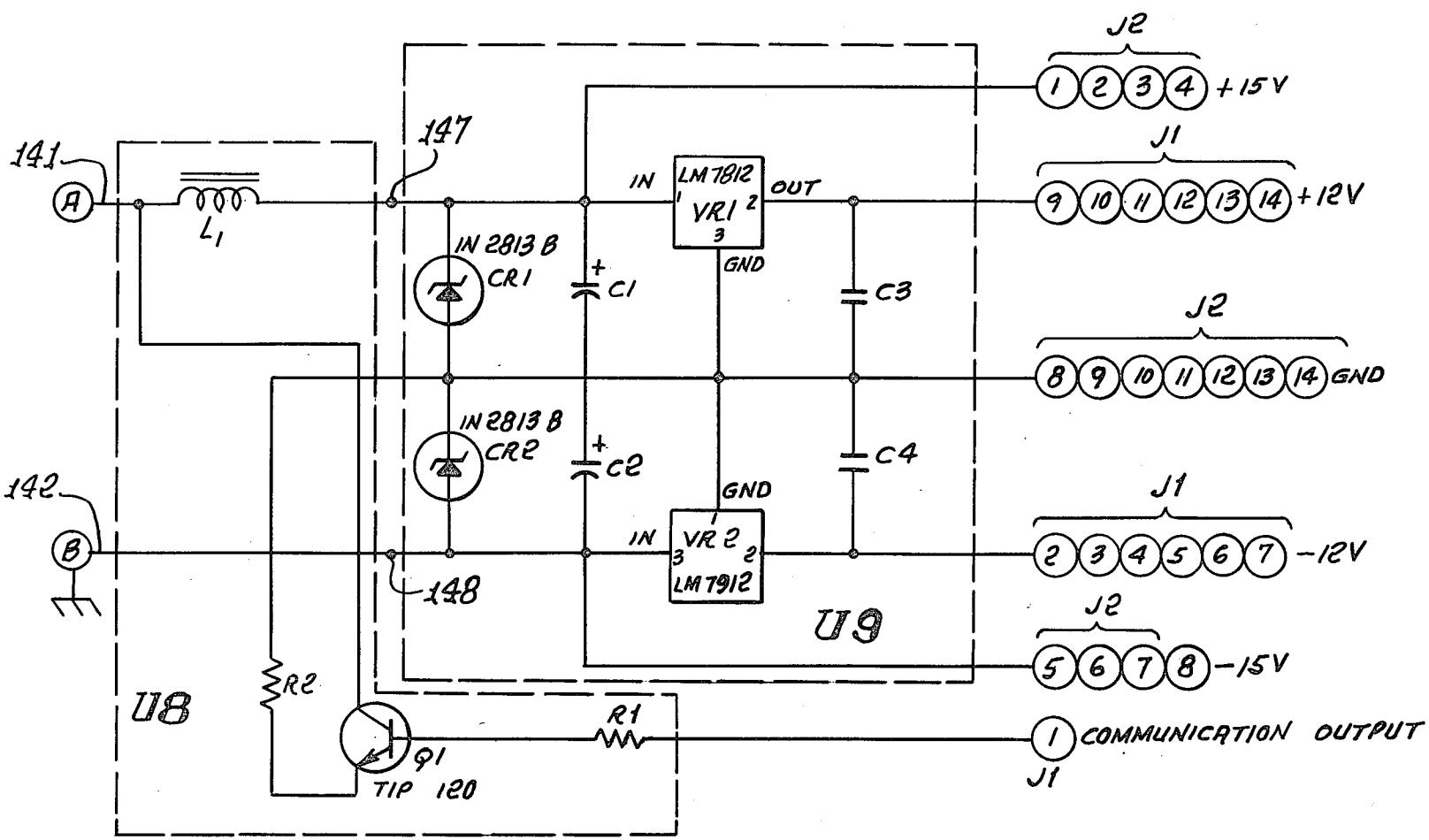
Figure 3A:
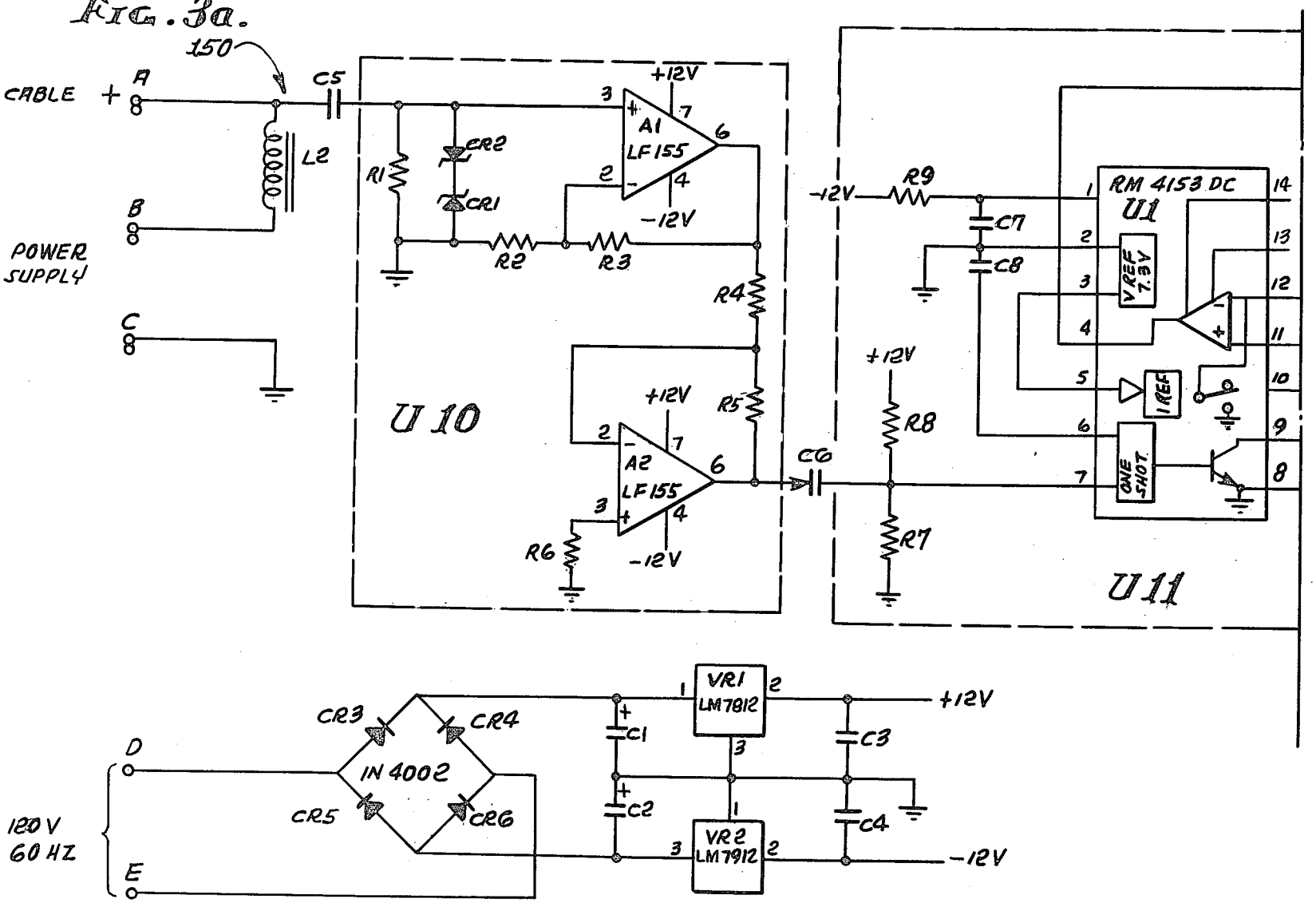
Figure 3B:
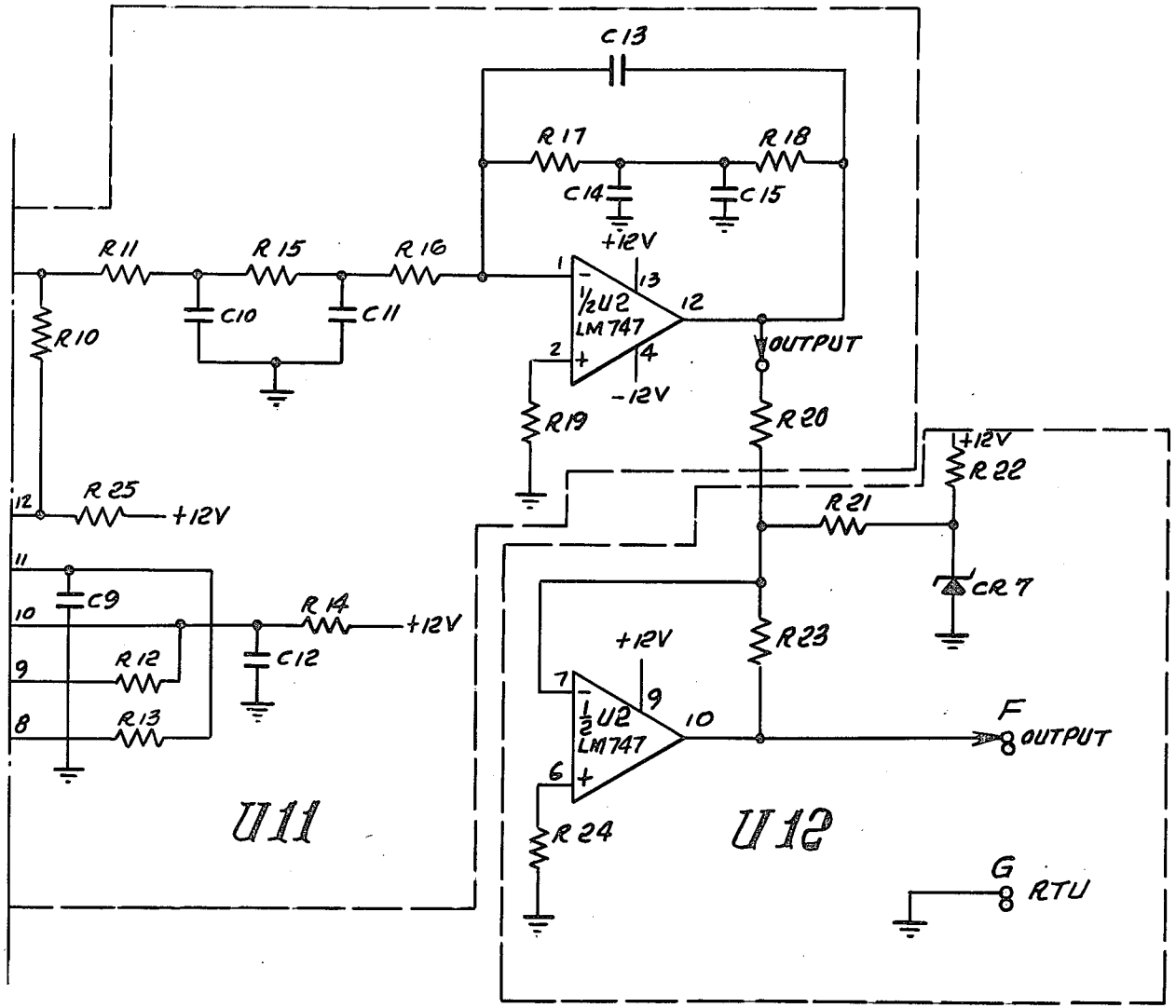
Figure 7:
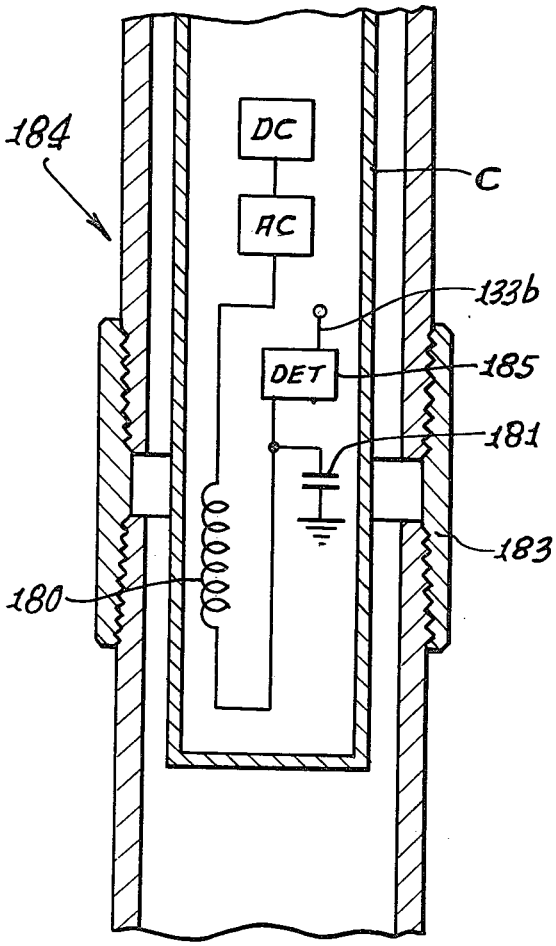
FIG. 7 is a schematic showing of a pipe or tubing collar locater.
Figure 8:
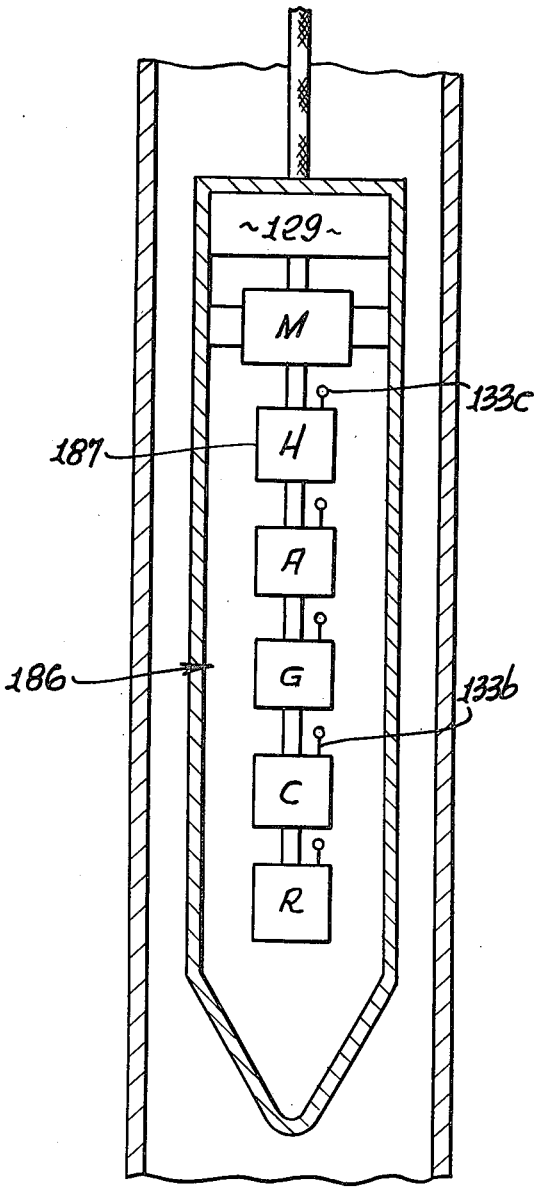
FIG. 8 is a schematic showing of instrumentation including a magnetometer.

Referring now to FIG. 1, analog voltages from the angular rate sensor or sensors (as for example gyroscopes $G_1$ and $G_2$ in FIG. 6) are supplied on lead or leads 130; analog signals from the accelerometer or accelerometers (as for example at $A_1$ and $A_2$ in FIG. 6) are supplied on lead or leads 131, and analog signals from other sensors (as for example heat sensors, such as thermisters). Signals from a collar locater as also shown in FIG. 7, and a magnetometer as shown in FIG. 8) are supplied on lead or leads **133*a*–133*c*. These signals are applied to analog multiplexer U4, whose output at lead 135 contains time division, series multiplexed versions of the analog signals supplied as described. Lead 135 supplies the multiplexed signals to analog to digital converter U5, whose output is digital on bus 137. Clock pulses are supplied at 136 to U5 as from a master clock U1 and divider U2**.

Shift register U6 receives the digital signals via bus 137, and supplies framing bit information to convert the signals to RS 232 interface compatible serial digital words. As an alternate, the output from the converter U5 may be processed and stored at 190, and supplied to U6. Examples of such processing are averaging of data and computing of azimuth and tilt as per co-pending application of Ott et al entitled, "Azimuth Determination for Vector Sensor Survey Tools", Ser. No. 351,744, filed Feb. 24, 1982, co-pending.

The CMOS compatible serial digital signal supplied at 138 from U6 output is transmitted to FSK device U7, which converts a typically 0 to 12 volts DC logic level signal to a 19.2 kHz–38.4 kHz frequency shift keying signal level (CMOS compatible). Note timing signal inputs at $F_1$ and $F_2$ from the divider U2. This signal is applied at 139 to device U8 which is a mixer stage that superimposes the FSK signal on the DC wireline voltage, and connected with power supply regulator U9, as shown. The output (versions of the digital words) from U8 is applied via leads 141 and 142 to the two coaxial conductors 143 and 144 of wireline 145, for upward transmission on that line.

DC Power applied from source 146 at the well surface to the wireline 145 is removed via regulator U9 at the instrumentation level in the borehole, for supply to such instrumentation and associated circuitry. See leads 147 and 148. Accordingly, the wireline 145 serves a dual function.

At the upper end of the wireline, the FSK signal is stripped off the line 145 by means of high pass filter 150 and signal conditioner U10 connected in series with the filter. The output 151 from U10 is a frequency modulated digital signal (−15 V DC to +15 V DC, for example) which is supplied at 152 to a frequency to a voltage converter U11. The output 153 from the latter is a low voltage level digital signal (−3 V DC to −5 V DC, for example), which is supplied to level shifter U12 for conversion to standard signal levels, directly compatible with any computer's serial RS-232 I/O port, indicated at 154. See computer 155 and display and/or recorder equipment 156.

FIGS. *2a–2d* and *3a–3b* are circuit diagrams showing representative circuit blocks of FIG. 1 in greater detail.

FIG. 7 shows a collar detector C (see also FIG. 4) with an output terminal **133*b* transmitting analog signals to the multiplexer U4 as described in FIG. 1. It may, for example, include an inductance 180 forming part of a filter that also includes capacitor 181. As an AC signal is transmitted to the filter, its cut-off frequency is shifted whenever the detector C is lowered past a ferrous collar 183 in the tubing or drill string 184, and that shifting is detected at 185 to produce a pulse at terminal 133*b***.

FIG. 8 shows instrumentation 186 like that of FIG. 4, except that detector C is included, as well as a magnetic field detector or magnetometer 187. Signals from output terminal **133*c* are transmitted to multiplexer U4. Magnetometer 187** may be of the type manufactured by Develco, Inc.

Inductors $L_1$ (see U8) and $L_2$ (see U10) serve as buffers or low pass filters to pass DC, but block the high frequency data signal (at $F_1$ and $F_2$, i.e. 19.2 and 38.4 kHz) on the wireline from passing into the power supply 146 or the regulator U9. The supply may be Model DCR 300 1.5B produced by Sorenson Co.

We claim:

1. In apparatus used in borehole mapping or surveying and including instrumentation for the determination of borehole azimuth and/or tilt, the combination comprising (a) means for suspending said instrumentation in the borehole, (b) said instrumentation operating to generate analog signals in the borehole, (c) means responsive to reception of said signals for multiplexing said signals and converting same to digital signals, in the borehole, (d) means responsive to reception of said digital signals for converting said digital signals to digital words, (e) FSK means in the borehole connected to receive said words and produce signal versions thereof at an FSK signal level, (f) a two conductor wireline in the borehole connected to transmit DC voltage downwardly to said instrumentation and to transmit versions of said digital words upwardly in the borehole, (g) a mixer stage in the borehole connected to superimpose said FSK signal versions onto the DC wireline voltage for said transmission upwardly in the borehole, (h) means for stripping said signal versions off the wireline at an upper elevation and processing said signal versions to a form usable in determination of borehole azimuth and/or tilt at the level of said instrumentation in the borehole, (i) means supplying DC power on said wireline downwardly in the borehole to said instrumentation via a sub-surface power supply regulator, (j) said sub-paragraph (g) mixer stage and said sub-paragraph (h) means including inductors operating to pass said DC power but blocking said FSK signal versions from passing into said sub-paragraph (i) power supply means and into said sub-surface power supply regulator.

2. The combination of claim 1 wherein said (d) means includes a shift register operating in the borehole to temporarily store said digital signals and to convert same to said digital words.

3. The combination of claim 1 wherein said (h) means includes:

(i) a filter and an FM to digital converter operating to strip said signal versions off the wireline and to condition said signal versions to provide voltage varying digital signal.

4. The combination of claim 3 wherein said voltage varying digital signal varies between −3 and −5 volts DC.

5. The combination of claim 3 wherein said (h) means includes circuitry for converting said voltage varying digital signal to signal levels directly compatible with a computer I/O port.

6. The combination of claim 1 wherein said instrumentation includes angular rate sensor means and acceleration sensor means which are operated to generate said analog signals of sub-paragraph (b).

7. The combination of claim 6 wherein said instrumentation includes temperature sensor means operated to generate along signals of sub-paragraph (b).

8. The combination of claim 1 wherein said instrumentation includes pipe or tubing collar locater means operated to generate analog signals of sub-paragraph (b) and indicative of the presence or absence of such a collar at the instrumentation level in the borehole.

9. The combination of claim 1 wherein said instrumentation includes mangetometer means operated to generate analog signal of sub-paragraph (b) and indicative of magnetic field conditions in or near the borehole at the level of said instrumentation.

* * * * *